US006260269B1

(12) United States Patent
Turnquist et al.

(10) Patent No.: US 6,260,269 B1
(45) Date of Patent: Jul. 17, 2001

(54) METHOD FOR OVERHAULING A STEAM TURBINE TO INCREASE ITS POWER

(75) Inventors: Norman Arnold Turnquist, Carlisle; Osman Saim Dinc, Troy; George Ernest Reluzco, Schenectady; Daniel Richard Cornell, Clifton Park; Robert Harold Cromer, Johnstown; Kenneth Elmer Robbins, Burnt Hills; Christopher Edward Wolfe, Niskayuna, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/454,720

(22) Filed: Dec. 7, 1999

Related U.S. Application Data

(63) Continuation-in-part of application No. 09/122,960, filed on Jul. 27, 1998, now Pat. No. 6,053,699.

(51) Int. Cl.[7] ..... B23P 15/00

(52) U.S. Cl. ..... 29/889.1; 29/889.2; 29/401.1

(58) Field of Search ..... 29/889.1, 889.2, 29/401.1, 402.02, 402.04, 402.08; 415/231, 174.2, 174.5, 230; 277/355

(56) References Cited

U.S. PATENT DOCUMENTS

| | | | | |
|---|---|---|---|---|
| 885,032 | * | 4/1908 | Ferranti . | |
| 1,757,212 | * | 5/1930 | Parsons et al. . | |
| 3,778,182 | * | 12/1973 | Hohn et al. | 415/101 |
| 5,613,829 | * | 3/1997 | Wolfe et al. | 415/174.1 |
| 5,630,590 | * | 5/1997 | Bouchard et al. | 277/53 |
| 5,678,898 | * | 10/1997 | Bagepalli et al. | 300/21 |

* cited by examiner

*Primary Examiner*—I Cuda Rosenbaum
(74) *Attorney, Agent, or Firm*—Donald S. Ingraham; Douglas E. Stoner

(57) ABSTRACT

A method for overhauling a steam turbine to increase its power without increasing its overall length. Existing seal assemblies containing seals other than brush seals are replaced with longitudinally-shorter replacement seal assemblies having only brush seals. An existing turbine section, such as a high-pressure turbine section, is replaced with a longitudinally-longer replacement turbine section having additional stages (i.e., additional rows of rotating buckets or blades).

16 Claims, 3 Drawing Sheets

METHOD FOR OVERHAULING A STEAM TURBINE TO INCREASE ITS POWER

CROSS-REFERENCE TO RELATED APPLICATIONS

The present patent application is a continuation-in-part application of US patent application Ser. No. 09/122,960 by Norman A. Turnquist et al. which is entitled "Steam Turbine Having a Brush Seal Assembly" and which was filed Jul. 27, 1998, now U.S. Pat. No. 6,053,699.

BACKGROUND OF THE INVENTION

The present invention relates generally to steam turbines, and more particularly to a method for increasing the power output of an existing steam turbine. A steam turbine has a steam path which typically includes, in serial-flow relationship, a steam inlet, a turbine, and a steam outlet. A gas turbine has a gas path which typically includes, in serial-flow relationship, an air intake (or inlet), a compressor, a combustor, a turbine, and a gas outlet (or exhaust nozzle). Gas or steam leakage, either out of the gas or steam path or into the gas or steam path, from an area of higher pressure to an area of lower pressure, is generally undesirable. For example, gas-path leakage in the turbine or compressor area of a gas turbine, between the rotating rotor shaft of the turbine or compressor and the circumferentially surrounding turbine or compressor casing, will lower the efficiency of the gas turbine leading to increased fuel costs. Also, steam-path leakage in the turbine area of a steam turbine, between the rotating shaft of the turbine and the circumferentially surrounding casing, will lower the efficiency of the steam turbine leading to increased fuel costs.

The turbine portion of a steam turbine typically includes a high-pressure turbine section, perhaps an intermediate-pressure turbine section, and a low-pressure turbine section each having rotatable steam-turbine blades fixedly attached to, and radially extending from, a steam-turbine shaft which is rotatably supported by bearings. The bearings usually are located longitudinally outward from the high and low-pressure turbine sections and longitudinally between the high and intermediate-pressure turbine sections. Usually the steam pressure drop through a high-pressure or an intermediate-pressure turbine section is a least generally 2,000 kPa (kiloPascals), and the difference in pressure of the steam entering the high and intermediate-pressure turbine sections is at least generally 600 kPa. It is noted that the steam exiting the high-pressure turbine section normally is reheated by the boiler before entering the intermediate-pressure turbine section and that the "steam" exiting the low-pressure turbine section enters a condenser before being directed to the boiler, as is known to the artisan.

Labyrinth seals have been used to minimize steam-path leakage between the high-pressure turbine section and its longitudinally-outward bearing, between the low-pressure turbine section and its longitudinally-outward bearing, and between the high and intermediate-pressure turbine sections. Such labyrinth seals consist of longitudinally spaced-apart rows of labyrinth seal teeth. Many rows of teeth are needed to seal against the high-pressure differentials found in a typical steam turbine, and this has contributed to the impressive longitudinal length (sometimes over fifteen meters) of a standard steam turbine used by power utilities to turn a generator for the production of electricity. Such length has required extra bearings to support the steam-turbine rotor.

It is noted that brush seals are used to minimize leakage through a gap between two components, wherein such leakage is from a higher pressure area to a lower pressure area. Brush seals have been used, or their use proposed, in rotating machinery. Such use or proposed use includes, but is not limited to, turbomachinery including steam turbines and gas turbines used for power generation and gas turbines used for aircraft and marine propulsion. It is noted that brush seals minimize the leakage of steam in steam turbines and minimize the leakage of compressed air or combustion gases in gas turbines.

The brush seals usually have wire or ceramic bristles conventionally welded or otherwise affixed to a backing plate. To improve performance, such brush seals typically align their wire bristles to contact the rotating rotor shaft at an angle between generally forty-five and generally sixty degrees with respect to a radius line from the center of the rotor to the point of bristle contact. For high pressure applications, a seal plate is positioned against the seal bristles on the downstream side (i.e., lower-pressure side) of the brush seal. Brush seals do a better sealing job than labyrinth seals, as can be appreciated by the artisan. However, all known steam turbines or steam turbine designs which rely on a brush seal assembly between turbine sections or between a turbine section and a bearing also rely on a standard labyrinth seal which acts as a backup seal for the brush seal assembly.

In overhauling a steam turbine, it is noted that an installed steam turbine has an existing length which is a fixed maximum length which cannot be made longer because of a connected generator and nearby associated equipment, building walls, etc. What is needed is a method for overhauling a steam turbine to increase its power without increasing its overall length.

BRIEF SUMMARY OF THE INVENTION

A first expression of the method of the invention is for overhauling a steam turbine to increase its power without increasing its overall length, wherein the steam turbine has a longitudinally-extending shaft, a first existing turbine section, a first bearing, and a first existing seal assembly. The first existing turbine section has a length and a number of stages each having rotatable turbine blades attached to said shaft. The first bearing rotatably supports the shaft. The first existing seal assembly has a longitudinal length, is longitudinally positioned between the first existing turbine section and the first bearing, is radially positioned near the shaft, and contains N rows of labyrinth-seal teeth. In the first expression of the invention, a method for increasing power of an existing steam turbine includes steps a) and b). Step a) includes replacing the first existing seal assembly with a first replacement seal assembly, wherein the first replacement seal assembly contains brush seals and from zero to N minus one rows of labyrinth-seal teeth and wherein the first replacement seal assembly has a longitudinal length which is shorter than the longitudinal length of the first existing seal assembly. Step b) includes replacing the first existing turbine section with a first replacement turbine section, wherein the first replacement turbine section has a length which is longer than the length of the first existing turbine section, wherein the first replacement turbine section has a number of stages which is greater than the number of stages of the first existing turbine section, and wherein the sum of the length of the first replacement turbine section and the longitudinal length of the first replacement seal assembly does not exceed the sum of the length of the first existing turbine section and the longitudinal length of the first existing seal assembly.

A second expression of the method of the invention is for overhauling a steam turbine to increase its power without increasing its overall length, wherein the steam turbine has a longitudinally-extending shaft, a first existing turbine section, a second existing turbine section, and a second existing seal assembly. The first existing turbine section has a length and a number of stages each having rotatable turbine blades attached to the shaft. The second existing turbine section is longitudinally spaced apart from the first existing turbine section without an intervening bearing, has a length, and has a number of stages each having rotatable turbine blades attached to the shaft. The second existing seal assembly has a longitudinal length, is longitudinally positioned between the first and second existing turbine sections, is radially positioned near the shaft, and contains R rows of labyrinth-seal teeth. In the second expression of the invention, a method for increasing power of an existing steam turbine includes steps a) and b). Step a) includes replacing the second existing seal assembly with a second replacement seal assembly, wherein the second replacement seal assembly contains brush seals and from zero to R minus one rows of labyrinth-seal teeth and wherein the second replacement seal assembly has a longitudinal length which is shorter than the longitudinal length of the second existing seal assembly. Step b) includes replacing the first existing turbine section with a first replacement turbine section, wherein the first replacement turbine section has a length which is longer than the length of the first existing turbine section, wherein the first replacement turbine section has a number of stages which is greater than the number of stages of the first existing turbine section, and wherein the sum of the length of the first replacement turbine section and the longitudinal length of the second replacement seal assembly does not exceed the sum of the length of the first existing turbine section and the longitudinal length of the second existing seal assembly.

A third expression of the invention combines the methods of the previously-described first and second expressions of the invention, wherein the sum of the length of the first replacement turbine section and the longitudinal lengths of the first and second replacement seal assemblies does not exceed the sum of the length of the first existing turbine section and the longitudinal lengths of the first and second existing seal assemblies.

Several benefits and advantages are derived from the method of the invention. Replacing existing seal assemblies having primary or backup labyrinth seal teeth (or other non-brush-seal sealing elements) with replacement seal assemblies having only brush seals will shorten the longitudinal length of the replacement seal assemblies. The steam-turbine overhauling method uses the saved longitudinal length of the replacement seal assemblies to replace turbine sections with replacement turbine sections having one or more additional stages which occupy the longitudinal space of the saved longitudinal length without increasing the overall length of the steam turbine, such additional stages increasing the power of the existing steam turbine. In a typical steam turbine having an overall length of 15 meters, engineering analysis shows the steam-turbine overhauling method of the invention can add generally five stages to the high-pressure turbine section and increase the power of the steam turbine by generally five percent without increasing its overall length.

DETAILED DESCRIPTION OF THE INVENTION

Figure 1:
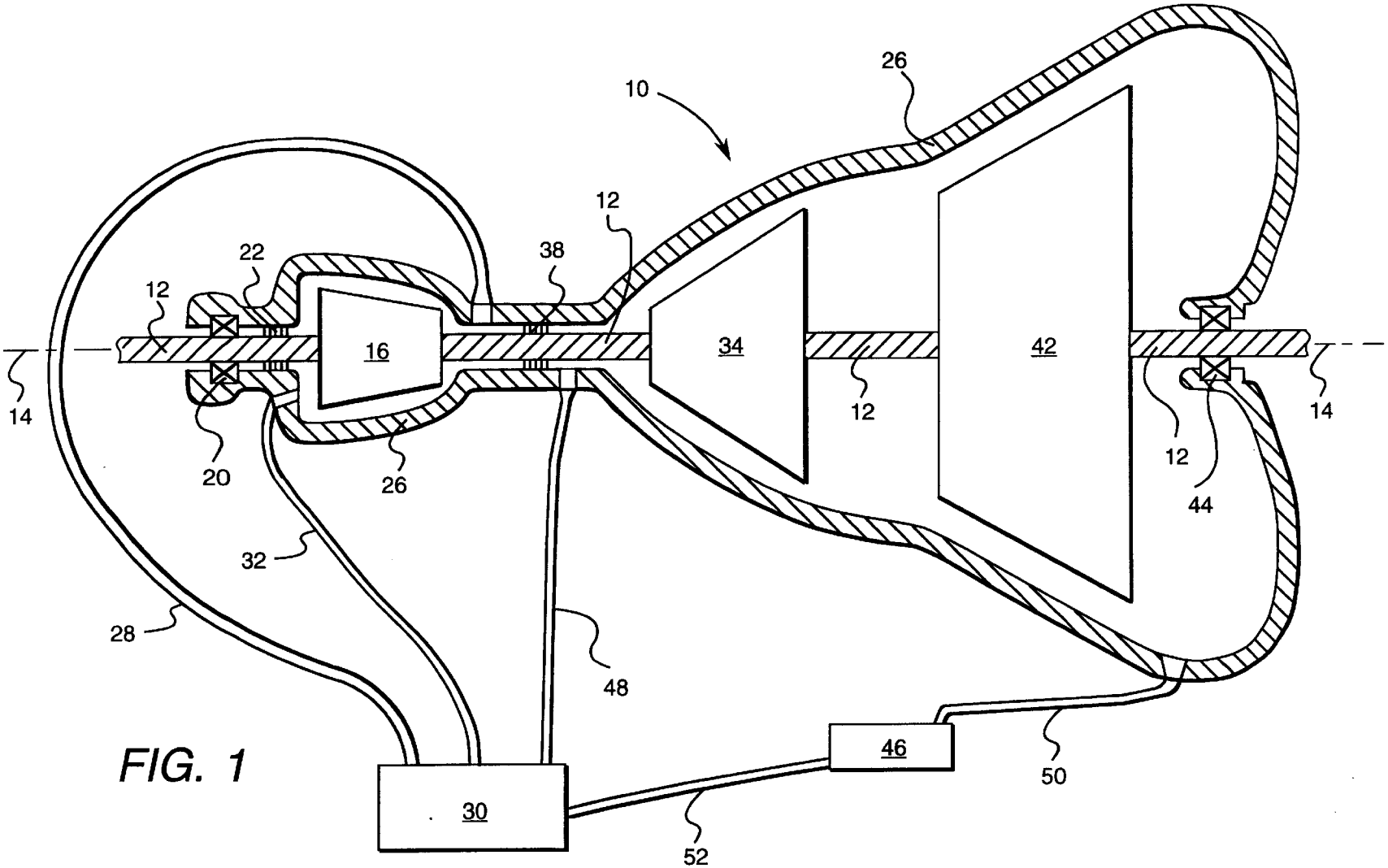
FIG. 1 is a schematic, partially cross-sectional view of an embodiment of a steam turbine overhauled by a method of the present invention.
Figure 2:
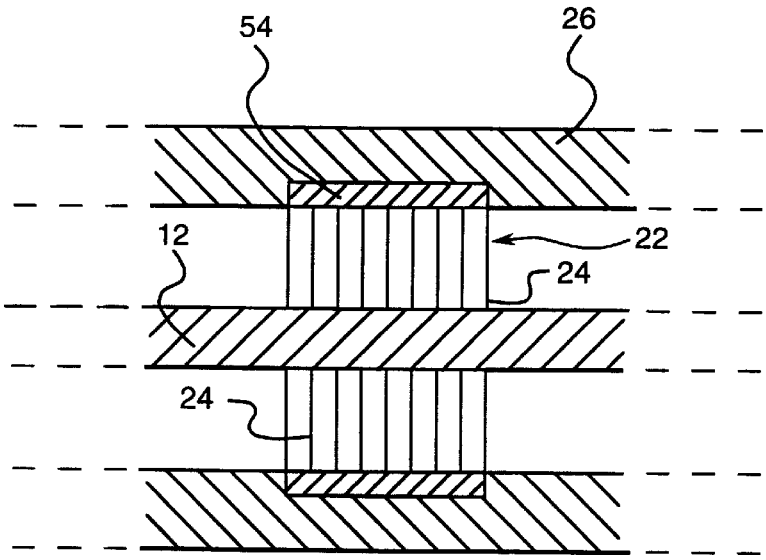
FIG. 2 is an enlarged view of a portion of the overhauled steam turbine of FIG. 1 showing the first replacement seal assembly and surrounding area.
Figure 3:
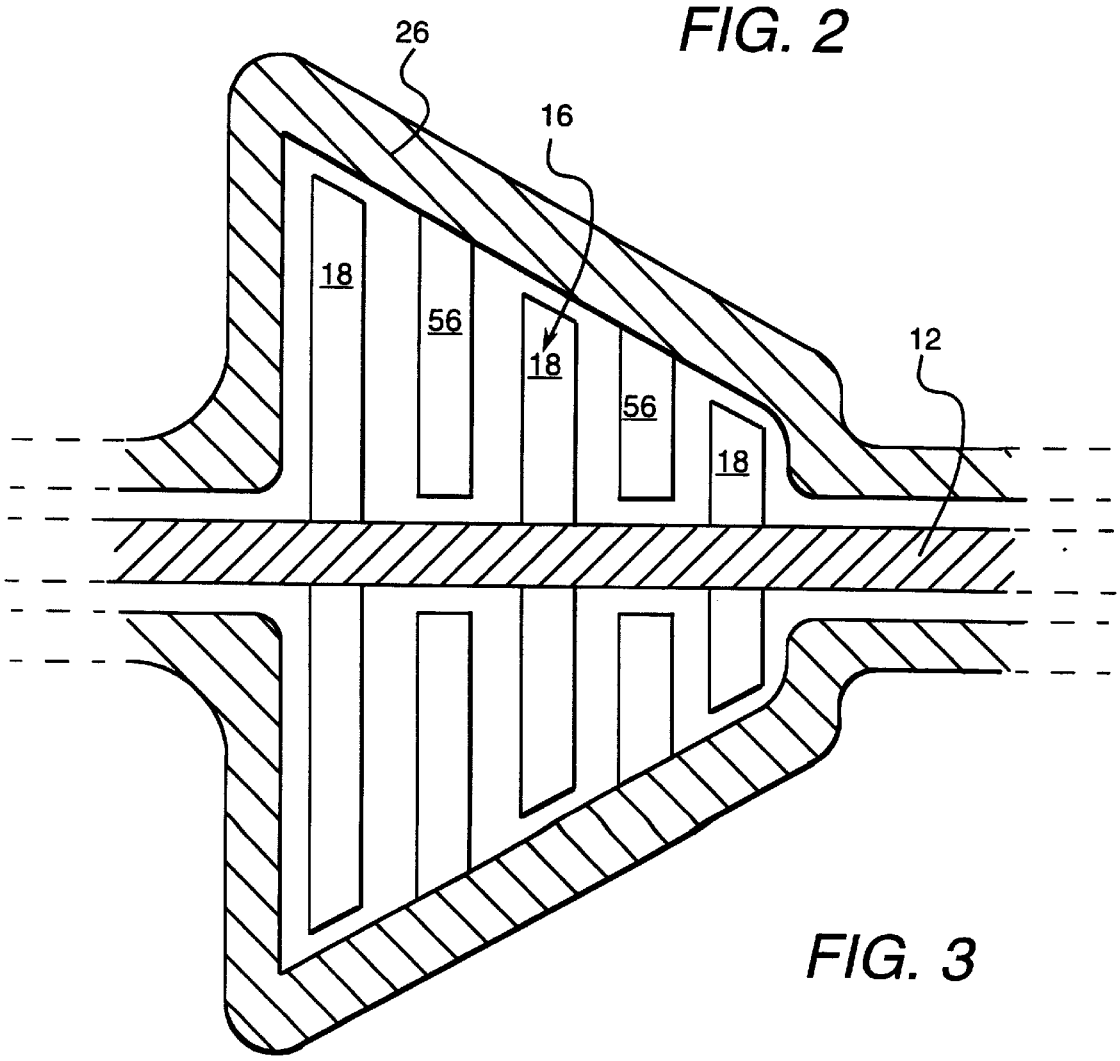
FIG. 3 is an enlarged view of a portion of the overhauled steam turbine of FIG. 1 showing the first replacement turbine section (which happens to be a high-pressure turbine section) and surrounding area.

Referring now to the drawings, FIGS. 1–3 schematically show an embodiment of a steam turbine 10 which has been overhauled by a method of the present invention. In a first expression of the embodiment shown in the figures, the overhauled steam turbine 10 includes a steam-turbine shaft 12 having a generally longitudinally-extending axis 14. The shaft 12 may comprise a single monolithic shaft or may comprise two or more shaft sections which are affixed together to create the overall shaft 12. It is understood, for the purpose of describing the present invention, that the term "shaft" includes "disc" or "wheel" and the like.

The overhauled steam turbine 10 also includes a first replacement turbine section 16 having rotatable steam-turbine blades 18 fixedly attached to, and radially extending from, the shaft 12. The blades 18 are also known as buckets or airfoils. The terminology "fixedly attached to" means the blades 18 turn with the shaft 12. It is understood that the blades 18 may be detached from the shaft 12 for inspection, repair, replacement, and the like. Typically, the blades 18 extend radially outward from the shaft 12. Steam enters the first replacement turbine section 16 at a first pressure. In one example, the first replacement turbine section 16 is a high-pressure turbine section wherein the steam pressure drop through the first replacement turbine section 16 is at least generally three-hundred 2,000 kPa (kiloPascals). In a typical steam turbine design, the first pressure is between generally 8,300 kPa and generally 24,000 kPa, and the pressure of the steam exiting the first replacement turbine section 16 is generally 4,000 kPa.

The overhauled steam turbine 10 additionally includes a first bearing 20 longitudinally spaced apart from the first replacement turbine section 16 and rotatably supporting the shaft 12. In one design, the first bearing 20 is a combination journal and thrust bearing as can be appreciated by those skilled in the art. A tapered land or tilting pad bearing is typically used.

The overhauled steam turbine 10 moreover includes a first replacement seal assembly 22 longitudinally disposed between the first replacement turbine section 16 and the first bearing 20 and radially disposed proximate the shaft 12. The first replacement seal assembly 22 contains seals which, in one example, are only brush seals which include a plurality of bristles 24 (most clearly shown in FIG. 2) having tips which, in one design, generally contact the shaft 12. In one application, the overhauled steam turbine 10 does not have any backup seal (such as, but not limited to, a labyrinth seal) to the bristles 24 of the first existing seal assembly 22. It is understood that the bristles 24 of the first replacement seal assembly 22 may comprise one or more packets of bristles and that such packets may be located only in one area or may be longitudinally spaced apart from each other so as to be positioned at discrete sealing locations. It is further understood that the first replacement seal assembly 22 does not contain other types of seals including, without limitation, labyrinth seals. In one example, the bristles 24 of the first replacement seal assembly 22 provide at least generally ninety-percent of the total steam-sealing capability of all seals taken together which are longitudinally disposed between the first replacement turbine section 16 and the first bearing 20 and radially disposed proximate the shaft 12. In an exemplary enablement, the first replacement seal assembly 22 is the only seal longitudinally disposed between the first replacement turbine section 16 and the first bearing and radially disposed proximate the shaft 12.

Other components of the overhauled steam turbine 10 include a (typically stationary) casing 26 which is radially spaced apart from and generally circumferentially surrounds the shaft 12 and the first replacement turbine section 16. The first bearing 20 and the first replacement seal assembly 22 are attached to the casing 26. A first conduit 28 directs steam from a boiler 30 to the inlet of the first replacement turbine section 16, and a second conduit 32 directs steam from the outlet of the first replacement turbine section 16 back to the boiler 30 for reheating.

In a second expression of the embodiment shown in the figures, the overhauled steam turbine 10 includes the shaft 12 and the first replacement turbine section 16 of the previously-described first expression of the embodiment shown in the figures. Additionally, the overhauled steam turbine 10 includes a second existing turbine section 34 longitudinally spaced apart from the first replacement turbine section 16 without an intervening bearing. The second existing turbine section 34 has rotatable steam-turbine blades 36 fixedly attached to, and radially extending from, the shaft 12. Steam enters the second existing turbine section 34 at a second pressure which is different from the first pressure. In one example, the second existing turbine section 34 is an intermediate-pressure turbine section wherein the steam pressure drop through the second existing turbine section 34 is at least generally 2,000 kPa and wherein the difference between the first pressure of the first replacement turbine section 16 and the second pressure of the second existing turbine section 34 is at least generally 600 kPa. In a typical steam turbine design, the second pressure is generally 4,000 kPa, and the pressure of the steam exiting the second existing turbine section 34 is generally 1,000 kPa.

Further, the overhauled steam turbine 10 includes a second replacement seal assembly 38 longitudinally disposed between the first replacement turbine section 16 and the second existing turbine section and 34 and radially disposed proximate the shaft 12. The second replacement seal assembly 38 contains seals which, in one example, are only brush seals which include a plurality of bristles 40 having tips which, in one design, generally contact the shaft 12. In one application, the overhauled steam turbine 10 does not have any backup seal (such as, but not limited to, a labyrinth seal) to the bristles 40 of the second replacement seal assembly 38. It is understood that the bristles 40 of the second replacement seal assembly 38 may comprise one or more packets of bristles and that such packets may be located only in one area or may be longitudinally spaced apart from each other so as to be positioned at discrete sealing locations. It is further understood that the second replacement seal assembly 38 does not contain, in addition to the bristles 40, other types of seals including, without limitation, labyrinth seals. In one example, the bristles 40 of the second replacement seal assembly 38 provide at least generally ninety-percent of the total steam-sealing capability of all seals taken together which are longitudinally disposed between the first replacement turbine section 16 and the second existing turbine section 34 and radially disposed proximate the shaft 12. In one design, the second replacement seal assembly 38 is the only seal longitudinally disposed between the first replacement turbine section 16 and the second existing turbine section 34 and radially disposed proximate the shaft 12.

Other components typically found in the steam turbine 10 include a low-pressure turbine section 42, a second bearing 44, and a condenser 46. Steam typically enters the low-pressure turbine section 42 at generally 150 psia and exits the low pressure turbine section 42 at subatmospheric pressure. A third conduit 48 directs steam from the boiler 30 to the inlet of the second existing turbine section 34, a fourth conduit 50 directs "steam" from the outlet of the second existing turbine section 34 to the condenser 46, and a fifth conduit 52 returns the condensed steam from the condenser 46 back to the boiler 30. It is noted that the casing 26 (which may be a single monolithic casing or attached-together longitudinal casing segments) additionally is radially spaced apart from and generally circumferentially surrounds the second existing turbine section 34 and the low-pressure turbine section 42. The second bearing 44 and the second brush seal assembly 38 are attached to the casing 26. In one design, the second bearing 44 is a tilting pad bearing.

In a third expression of the embodiment shown in the figures, the overhauled steam turbine 10 combines the components previously described for the first and second expressions of the embodiment shown in the figures. It is pointed out that FIG. 2 shows an enlarged first replacement seal assembly 22 and surrounding area of the steam turbine 10. The bristles 24 each have a fixed end which is attached to a plate 54 which is itself attached to the casing 26. The bristles 24 each have a free end (i.e., a tip) which is disposed proximate (and, in one design, generally contacts) the shaft 12. It is also pointed out that FIG. 3 shows an enlarged first replacement turbine section 16 and surrounding area of the steam turbine 10. It is seen that vanes 56 are attached to, and radially extend inwardly from, the casing 26.

Figure 4:
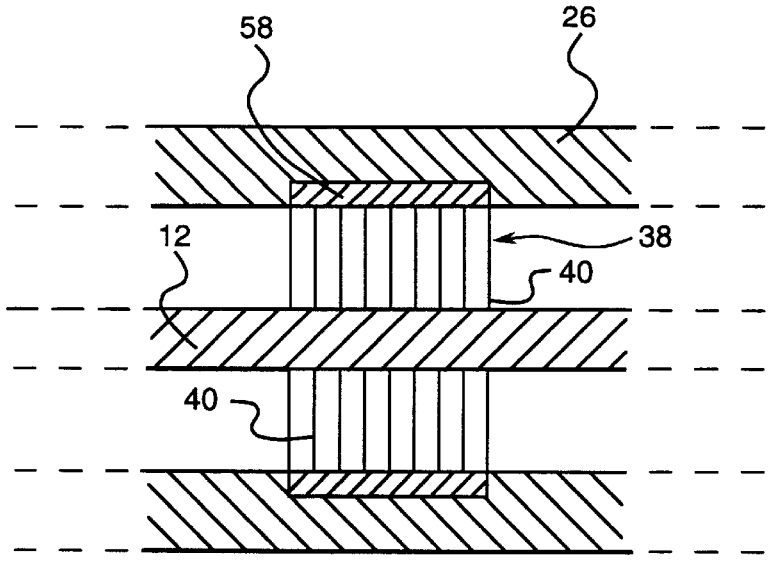
FIG. 4 is an enlarged view of a portion of the overhauled steam turbine of FIG. 1 showing the second replacement seal assembly and surrounding area.
Figure 5:
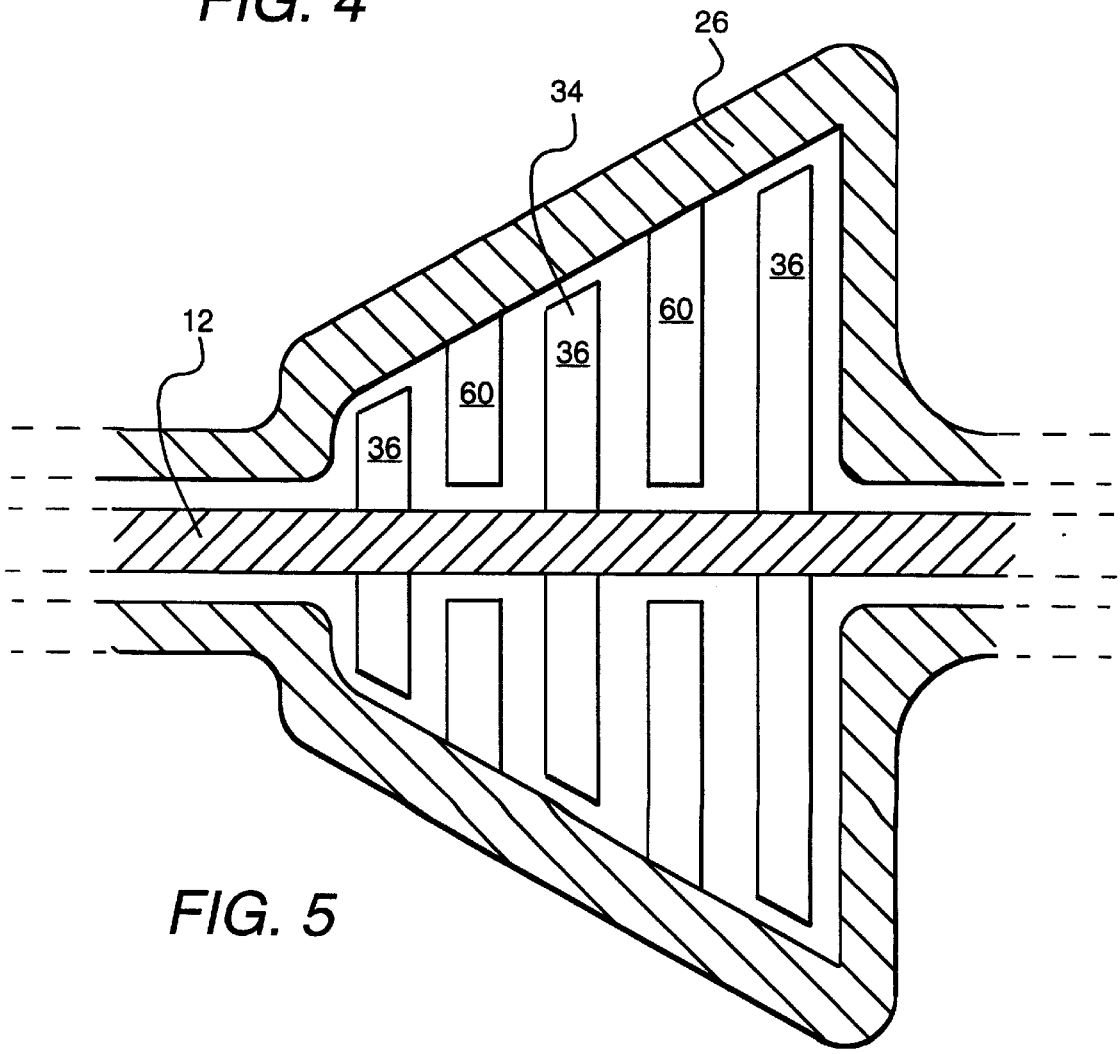
FIG. 5 is an enlarged view of a portion of the overhauled steam turbine of FIG. 1 showing the (non-replaced) second existing turbine section (which happens to be an intermediate-pressure turbine section) and surrounding area.

Likewise, FIG. 4 shows an enlarged second replacement seal assembly 38 and surrounding area of the steam turbine 10. The bristles 40 each have a fixed end which is attached to a plate 58 which is itself attached to the casing 26. The bristles 40 each have a free end (i.e., a tip) which is disposed proximate (and, in one design, generally contacts) the shaft 12. Also, FIG. 5 shows an enlarged (nonreplaced) second existing turbine section 34 and surrounding area of the overhauled steam turbine 10. It is seen that vanes 60 are attached to, and radially extend inwardly from, the casing 26. Exemplary materials for the bristles 24 and 40 include, without limitation, coated or uncoated metal (including alloy) wire bristles and ceramic wire bristles. In one application, the steam turbine of the present invention is a large utility steam turbine or a combined cycle steam turbine which is used to power one or more generators producing a total of at least two-hundred megawatts of electricity. It is noted that the casing 26 is shown in the figures as a single casing which surrounds the entire overhauled steam turbine 10. However, such single casing can be replaced by individual casings which are connected together and which surround only one (or more) of the individual components of the steam turbine, such as a high-pressure turbine section, etc.

From the previous expressions of the embodiment of the overhauled steam turbine 10 shown in the figures, it is seen that a first expression of the method of the invention is for overhauling a steam turbine to increase its power without increasing its overall length; wherein the steam turbine has a longitudinally-extending shaft, a first existing turbine section, a first bearing, and a first existing seal assembly; wherein the first existing turbine section has a length and a number of stages each having rotatable turbine blades attached to the shaft; wherein the first bearing rotatably supports the shaft; and wherein the first existing seal assembly has a longitudinal length, is longitudinally disposed between the first existing turbine section and the first bearing, is radially disposed proximate the shaft, and contains N rows of labyrinth-seal teeth. The method includes steps a) and b).

Step a) includes replacing the first existing seal assembly with a first replacement seal assembly 22, wherein the first replacement seal assembly 22 contains brush seals and from zero to N minus one rows of labyrinth-seal teeth and wherein the first replacement seal assembly 22 has a longitudinal length which is shorter than the longitudinal length of the first existing seal assembly. Step b) includes replacing the first existing turbine section with a first replacement turbine section 16, wherein the first replacement turbine section 16 has a length which is longer than the length of the first existing turbine section, wherein the first replacement turbine section 16 has a number of stages which is greater than the number of stages of the first existing turbine section, and wherein the sum of the length of the first replacement turbine section 16 and the longitudinal length of the first replacement seal assembly 22 does not exceed (and in one method generally equals) the sum of the length of the first existing turbine section and the longitudinal length of the first existing seal assembly. In one method, the first replacement seal assembly 22 contains zero rows of labyrinth-seal teeth, as shown in FIGS. 1 and 2. It is noted that, for ease of illustration, the first replacement turbine section 16 is shown as having three stages (i.e., three rows of steam turbine blades 18) in FIG. 3, but that an actual high-pressure turbine section typically has many more stages, as is known to the artisan.

It is also seen that a second expression of the method of the invention is for overhauling a steam turbine to increase its power without increasing its overall length; wherein the steam turbine has a longitudinally-extending shaft, a first existing turbine section, a second existing turbine section, and a second existing seal assembly; wherein the first existing turbine section has a length and a number of stages each having rotatable turbine blades attached to the shaft; wherein the second existing turbine section is longitudinally spaced apart from the first existing turbine section without an intervening bearing, has a length, and has a number of stages each having rotatable turbine blades attached to the shaft; and wherein the second existing seal assembly has a longitudinal length, is longitudinally disposed between the first and second existing turbine sections, is radially disposed proximate the shaft, and contains R rows of labyrinth-seal teeth. The method includes steps a) and b). Step a) includes replacing the second existing seal assembly with a second replacement seal assembly 38, wherein said second replacement seal assembly 38 contains brush seals and from zero to R minus one rows of labyrinth-seal teeth and wherein said second replacement seal assembly 38 has a longitudinal length which is shorter than said longitudinal length of said second existing seal assembly. Step b) includes replacing said first existing turbine section with a first replacement turbine section 16, wherein said first replacement turbine section 16 has a length which is longer than said length of said first existing turbine section, wherein said first replacement turbine section 16 has a number of stages which is greater than said number of stages of said first existing turbine section, and wherein the sum of said length of said first replacement turbine section 16 and said longitudinal length of said second replacement seal assembly 38 does not exceed (and in one method generally equals) the sum of said length of said first existing turbine section and said longitudinal length of said second existing seal assembly. In one method, the second replacement seal assembly 38 contains zero rows of labyrinth-seal teeth, as shown in FIGS. 1 and 4.

It is further seen that a third expression of the method of the invention is for overhauling a steam turbine to increase its power without increasing its overall length and combines the steps of the previously-described first and second expressions of the method of the invention. Here, the sum of the length of the first replacement turbine section 16 and the longitudinal lengths of the first and second replacement seal assemblies 22 and 38 does not exceed (and in one method generally equals) the sum of the length of the first existing turbine section and the longitudinal lengths of the first and second existing seal assemblies.

Adding stages to replacement turbine sections increases the power output of a steam turbine. The previously-described expressions of the method of the invention replaced a first existing turbine section, which was a high-pressure turbine section, with a first replacement turbine section 16 having additional stages. Other lower-pressure turbine sections can be replaced using the method of the invention. However, it is noted that, when increased power is the only concern, the best use of longitudinal length saved by using brush-seal-only replacement seal assemblies is to add more stages to the replacement high-pressure turbine section.

The foregoing description of several expressions of the method of the invention has been presented for purposes of illustration. It is not intended to be exhaustive or to limit the invention to the precise form disclosed, and obviously many modifications and variations in the method are possible in light of the above teaching. It is intended that the scope of the invention be defined by the claims appended hereto.

What is claimed is:

1. A method for overhauling a steam turbine to increase its power without increasing its overall length; wherein said steam turbine has a longitudinally-extending shaft, a first existing turbine section, a first bearing, and a first existing seal assembly; wherein said first existing turbine section has a length and a number of stages each having rotatable turbine blades attached to said shaft; wherein said first bearing rotatably supports said shaft; wherein said first existing seal assembly has a longitudinal length, is longitudinally disposed between said first existing turbine section and said first bearing, is radially disposed proximate said shaft, and contains N rows of labyrinth-seal teeth; and wherein said method includes the following steps:

a) replacing said first existing seal assembly with a first replacement seal assembly, wherein said first replacement seal assembly contains brush seals and from zero to N minus one rows of labyrinth-seal teeth and wherein said first replacement seal assembly has a longitudinal length which is shorter than said longitudinal length of said first existing seal assembly; and b) replacing said first existing turbine section with a first replacement turbine section, wherein said first replacement turbine section has a length which is longer than said length of said first existing turbine section, wherein said first replacement turbine section has a number of stages which is greater than said number of stages of said first existing turbine section, and wherein the sum of said length of said first replacement turbine section and said longitudinal length of said first replacement seal assembly does not exceed the sum of said length of the first existing turbine section and said longitudinal length of said first existing seal assembly.

2. The method of claim 1, wherein said brush seals of said first replacement seal assembly have bristles which provide at least generally ninety-percent of the total steam-sealing capability of all seals taken together which are longitudinally disposed between said first replacement turbine section and said first bearing and radially disposed proximate said shaft.

3. The method of claim 2, wherein the steam pressure drop through said first replacement turbine section is at least generally 2,000 kPa.

4. The method of claim 3, wherein said first replacement seal assembly is the only seal longitudinally disposed between said first replacement turbine section and said first bearing and radially disposed proximate said shaft.

5. A method for overhauling a steam turbine to increase its power without increasing its overall length; wherein said steam turbine has a longitudinally-extending shaft, a first existing turbine section, a second existing turbine section, and an existing seal assembly; wherein said first existing turbine section has a length and a number of stages each having rotatable turbine blades attached to said shaft; wherein said second existing turbine section is longitudinally spaced apart from said first existing turbine section without an intervening bearing, has a length, and has a number of stages each having rotatable turbine blades attached to said shaft; wherein said existing seal assembly has a longitudinal length, is longitudinally disposed between said first and second existing turbine sections, is radially disposed proximate said shaft, and contains R rows of labyrinth-seal teeth; and wherein said method includes the following steps:

a) replacing said existing seal assembly with a replacement seal assembly, wherein said replacement seal assembly contains brush seals and from zero to R minus one rows of labyrinth-seal teeth and wherein said replacement seal assembly has a longitudinal length which is shorter than said longitudinal length of said existing seal assembly; and b) replacing said first existing turbine section with a first replacement turbine section, wherein said first replacement turbine section has a length which is longer than said length of said first existing turbine section, wherein said first replacement turbine section has a number of stages which is greater than said number of stages of said first existing turbine section, and wherein the sum of said length of said first replacement turbine section and said longitudinal length of said replacement seal assembly does not exceed the sum of said length of said first existing turbine section and said longitudinal length of said existing seal assembly.

6. The method of claim 5, wherein said brush seals of said replacement seal assembly have bristles which provide at least generally ninety-percent of the total steam-sealing capability of all seals taken together which are longitudinally disposed between said first replacement turbine section and said second existing turbine section and radially disposed proximate said shaft.

7. The method of claim 6, wherein the steam pressure drop through each of said first replacement turbine section and said second existing turbine section is at least generally 2,000 kPa, and wherein the difference between the steam pressure entering said first replacement turbine section and the steam pressure entering said second existing turbine section is at least generally 600 kPa.

8. The method of claim 7, wherein said replacement seal assembly is the only seal longitudinally disposed between said first replacement turbine section and said second existing turbine section and radially disposed proximate said shaft.

9. A method for overhauling a steam turbine to increase its power without increasing its overall length; wherein said steam turbine has a longitudinally-extending shaft, a first existing turbine section, a first bearing, a first existing seal assembly, a second existing turbine section, and a second existing seal assembly; wherein said first existing turbine section has a length and a number of stages each having rotatable turbine blades attached to said shaft; wherein said first bearing rotatably supports said shaft; wherein said first existing seal assembly has a longitudinal length, is longitudinally disposed between said first existing turbine section and said first bearing, is radially disposed proximate said shaft, and contains N rows of labyrinth-seal teeth; wherein said second existing turbine section is longitudinally spaced apart from said first existing turbine section without an intervening bearing, has a length, and has a number of stages each having rotatable turbine blades attached to said shaft; wherein said second existing seal assembly has a longitudinal length, is longitudinally disposed between said first and second existing turbine sections, is radially disposed proximate said shaft, and contains R rows of labyrinth-seal teeth; and wherein said method includes the following steps:

a) replacing said first existing seal assembly with a first replacement seal assembly, wherein said first replacement seal assembly contains brush seals and from zero to N minus one rows of labyrinth-seal teeth and wherein said first replacement seal assembly has a longitudinal length which is shorter than said longitudinal length of said first existing seal assembly;

b) replacing said second existing seal assembly with a second replacement seal assembly, wherein said second replacement seal assembly contains brush seals and from zero to R minus one rows of labyrinth-seal teeth and wherein said second replacement seal assembly has a longitudinal length which is shorter than said longitudinal length of said second existing seal assembly; and c) replacing said first existing turbine section with a first replacement turbine section, wherein said first replacement turbine section has a length which is longer than said length of said first existing turbine section, wherein said first replacement turbine section as a number of stages which is greater than said number of stages of aid first existing turbine section, and wherein the sum of said length of said first replacement turbine section and said longitudinal lengths of said first and second replacement seal assemblies does not exceed the sum of said length of said first existing turbine section and said longitudinal lengths of said first and second existing seal assemblies.

10. The method of claim 9, wherein said brush seals of said first replacement seal assembly have bristles which provide at least generally ninety-percent of the total steam-sealing capability of all seals taken together which are longitudinally disposed between said first replacement turbine section and said first bearing and radially disposed proximate said shaft.

11. The method of claim 10, wherein the steam pressure drop through said first replacement turbine section is at least generally 2,000 kPa.

12. The method of claim 11, wherein said first replacement seal assembly is the only seal longitudinally disposed between said first replacement turbine section and said first bearing and radially disposed proximate said shaft.

13. The method of claim 12, wherein said brush seals of said second replacement seal assembly have bristles which provide at least generally ninety-percent of the total steam-sealing capability of all seals taken together which are longitudinally disposed between said first replacement turbine section and said second existing turbine section and radially disposed proximate said shaft.

14. The method of claim 13, wherein the steam pressure drop through second existing turbine section is at least generally 2,000 kPa.

15. The method of claim 14, wherein the difference between the steam pressure entering said first replacement turbine section and the steam pressure entering said second existing turbine section is at least generally 600 kPa.

16. The method of claim 15, wherein said second replacement seal assembly is the only seal longitudinally disposed between said first and second replacement turbine sections and radially disposed proximate said shaft.

* * * * *